US009168988B2

(12) United States Patent
Mohr et al.

(10) Patent No.: US 9,168,988 B2
(45) Date of Patent: Oct. 27, 2015

(54) METHOD OF CLEANING A ROTATING OBJECT

(71) Applicant: Loch Stock and Barrel LLC, Windsor, CO (US)

(72) Inventors: Mark Anthony Mohr, Slidell, LA (US); Anthony L. Newt, Windsor, CO (US); Jo Ann Newt, Windsor, CO (US)

(73) Assignee: Loch Stock and Barrel LLC, Windsor, CO (US)

( * ) Notice: Subject to any disclaimer, the term of this patent is extended or adjusted under 35 U.S.C. 154(b) by 0 days.

(21) Appl. No.: 14/695,641

(22) Filed: Apr. 24, 2015

(65) Prior Publication Data

US 2015/0217841 A1 Aug. 6, 2015

Related U.S. Application Data

(63) Continuation-in-part of application No. 14/167,687, filed on Jan. 29, 2014, now Pat. No. 9,016,224, which is a continuation of application No. 13/650,065, filed on Oct. 11, 2012, now Pat. No. 8,651,039, which is a continuation-in-part of application No. 12/930,103, filed on Dec. 27, 2010, now abandoned.

(51) Int. Cl.

| | |
|---|---|
| ***B08B 3/04*** | (2006.01) |
| ***B63B 59/08*** | (2006.01) |
| ***B08B 1/00*** | (2006.01) |

(52) U.S. Cl.

CPC ..... *B63B 59/08* (2013.01); *B08B 1/002* (2013.01)

(58) Field of Classification Search

USPC ..... 114/222; 134/32, 23, 45

See application file for complete search history.

(56) References Cited

U.S. PATENT DOCUMENTS

| | | | | |
|---|---|---|---|---|
| 1,063,804 | A | | 6/1913 | Kindermann |
| 1,337,173 | A | | 4/1920 | White |
| 1,494,448 | A | | 5/1924 | Sookne |
| 1,934,494 | A | * | 11/1933 | Gillespie ..... 134/7 |
| 3,227,124 | A | | 1/1966 | Campbell |
| 3,311,500 | A | * | 3/1967 | Toshimichi ..... 134/23 |
| 3,561,391 | A | | 2/1971 | Locati |
| 4,102,290 | A | | 7/1978 | Weiss |
| 4,204,494 | A | | 5/1980 | Bridwell et al. |
| 4,209,344 | A | * | 6/1980 | Simon et al. ..... 134/23 |
| 4,395,966 | A | | 8/1983 | Murphy |
| 4,648,344 | A | | 3/1987 | Burgers et al. |
| 4,843,995 | A | | 7/1989 | Bingham |
| 4,951,347 | A | | 8/1990 | Star et al. |
| 4,963,944 | A | * | 10/1990 | Tange ..... 399/357 |

(Continued)

OTHER PUBLICATIONS

U.S. Appl. No. 12/930,103, filed Dec. 27, 2010.

(Continued)

*Primary Examiner* — Stephen Avila

(74) *Attorney, Agent, or Firm* — Craig R. Miles; CR Miles P.C.

(57) ABSTRACT

A method of cleaning a rotatable object including obtaining a flexible line having a plurality of cleaning elements disposed along the central portion and further including engaging the cleaning elements disposed along the central portion with a rotatable object and affixing a first line end to a first support having a fixed location proximate a first end of the rotatable object and affixing a second line end to a second support having a fixed location proximate a second end of said rotatable object; and rotating the rotatable object to clean the rotatable object with the plurality of cleaning elements.

11 Claims, 17 Drawing Sheets

(56) References Cited

U.S. PATENT DOCUMENTS

| | | | | |
|---|---|---|---|---|
| 5,040,923 | A | 8/1991 | Do | |
| 5,351,640 | A | 10/1994 | Attaway et al. | |
| 5,598,804 | A | 2/1997 | Vostitsanos | |
| 5,913,558 | A * | 6/1999 | Simons | 294/24 |
| 5,983,431 | A | 11/1999 | Meshulam | |
| 6,158,449 | A * | 12/2000 | Kamikawa | 134/61 |
| 6,840,187 | B2 | 1/2005 | Tible | |
| 6,871,658 | B2 * | 3/2005 | Gjestvang | 134/167 R |
| 7,222,578 | B2 | 5/2007 | Kaneko | |
| 7,662,237 | B2 * | 2/2010 | Chaleix et al. | 134/1.1 |
| 8,651,039 | B2 | 2/2014 | Newt | |
| 8,778,087 | B2 * | 7/2014 | Tyrrell et al. | 134/6 |
| 2003/0005874 | A1 | 1/2003 | Miyoshi | |
| 2004/0149320 | A1 * | 8/2004 | Hutchinson | 134/32 |
| 2004/0158948 | A1 | 8/2004 | Sander et al. | |
| 2010/0051062 | A1 * | 3/2010 | Fischer et al. | 134/23 |

OTHER PUBLICATIONS

U.S. Appl. No. 14/167,687, filed Jan. 29, 2014.

* cited by examiner

METHOD OF CLEANING A ROTATING OBJECT

This United States Patent Application is a continuation-in-part of U.S. patent application Ser. No. 14/167,687, filed Jan. 29, 2014, now U.S. Pat. No. 9,016,224, issued Apr. 28, 2015, which is a continuation of U.S. patent application Ser. No. 13/650,065, filed Oct. 11, 2012, now U.S. Pat. No. 8,651,039, issued Feb. 18, 2014, which is a continuation-in-part of U.S. patent application Ser. No. 12/930,103, filed Dec. 27, 2010, now abandoned, each hereby incorporated by reference herein.

I. FIELD OF THE INVENTION

A method of cleaning a rotatable object including obtaining a flexible line having a plurality of cleaning elements disposed along the central portion and further including engaging the cleaning elements disposed along the central portion with a rotatable object and affixing a first line end to a first support having a fixed location proximate a first end of the rotatable object and affixing a second line end to a second support having a fixed location proximate a second end of said rotatable object; and rotating the rotatable object in relation to the plurality of cleaning elements to clean the rotatable object.

II. BACKGROUND OF THE INVENTION

The inventive method provides an advantage in the ready cleaning of rotatable objects. As one illustrative example, the inventive method substantially reduces the time, effort and expense of cleaning the external surface of cement mixer drums on cement trucks by providing a cleaning apparatus capable of conforming engagement of a plurality of cleaning elements over substantially the entire length of the rotatable object. By correspondingly affixing first and second ends of the cleaning apparatus to a first support having a fixed location proximate a first end said rotatable object a second support having a fixed location proximate a second end said rotatable object the rotatable object can be rotated in relation to the plurality of cleaning elements to remove, dislodge, or dissolve adhered materials.

Maintaining a clean boat hull can improve the performance and prolong the life of a boat while avoiding more expensive maintenance procedures. Conventional methods for cleaning a boat hull are typically by mechanical or chemical means out of water. To remove a boat from the water requires a lift and transport from the location at which the boat is docked to a boat yard at which the boat hull can be cleaned. Alternately, the boat can be supported above low tide and cleaned between low and high tide. Chemical means may include toxins or poisons which can necessitate the use of special equipment such as over garments and respirators and require extensive clean up after use.

Certain devices and methods for cleaning a boat hull while submerged have been described to avoid having to remove the boat from the water. U.S. Pat. No. 4,395,966 to Murphy discloses a boat hull scrubber having a one piece belt of abrasive material to which a plurality of floats couple along the undersurface. The floats pivot in relation to the belt. The floats forcibly urge the belt into contact with the hull of the boat as operators on the deck of the boat pull either end of the belt. There are several disadvantages to this type and similar types of belt and float technology. The floats can make the belt difficult to engage and control in positional relation to the hull, and the flat belt when drawn against the boat hull can be difficult to draw back an forth due to friction between the belt and the boat hull, and the surface of the belt may not provide a surface as effective in removing the material attached to the boat hull (such as bacterial growth, algae growth, barnacles, and the like) as brushes.

Similarly, U.S. Pat. No. 5,351,640 to Attaway describes a strap having a plurality of support pads located in cleaning loops disposed along the length of the strap which support cleaning pads in positional relation to the boat hull for cleaning. There are several disadvantages to supported cleaning pad technology. The supported cleaning pads can be operated in only one positional relation to the boat hull making placement of the device in relation to the boat hull more difficult. Additionally, cleaning pads may not readily release removed materials resulting which may act as abrasives and abrade the boat hull.

III. SUMMARY OF THE INVENTION

Accordingly, a broad object of the invention can be to provide a method for cleaning a rotatable object by obtaining a flexible line having a plurality of cleaning elements disposed along the central portion. By engaging the cleaning elements disposed along the central portion with the rotatable object to be cleaned and affixing a first line end to a first support having a fixed location proximate a first end of the rotatable object and affixing a second line end to a second support having a fixed location proximate a second end of the rotatable object, the rotatable object can be rotated in relation to the plurality of cleaning elements to clean the rotatable object.

Another broad object of the invention can be to provide a boat hull cleaning system which provides at least one flexible line having central portion along which a plurality cleaning elements have spaced engagement with each of the plurality of cleaning elements configured to provide a body from which a plurality of flexible members extend a sufficient distance to be engaged with the surface of the boat hull for cleaning.

Another broad object of the invention can be to provide a method of cleaning a boat hull by engagement of a plurality of cleaning elements each having a body from which a plurality of flexible members outwardly extend and which are attached to one or more flexible line(s). The one or more flexible lines can be reciprocally drawn toward the port side of the boat and then toward the starboard side of the boat to reciprocally slidly engage the surface of the flexible members with the boat hull.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
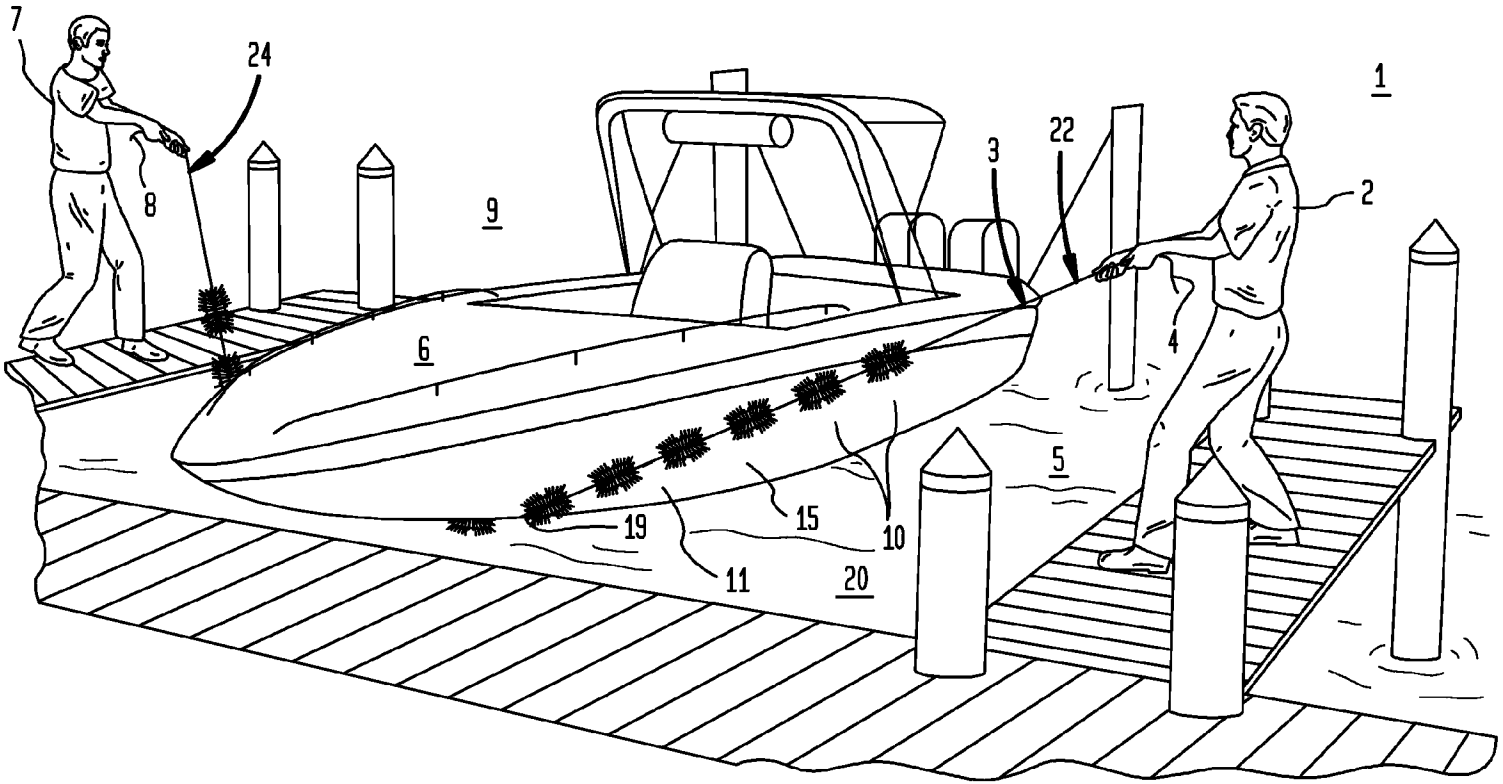
FIG. 1 is an illustration of a particular method of using a particular embodiment of the inventive boat hull cleaning device.
Figure 7:
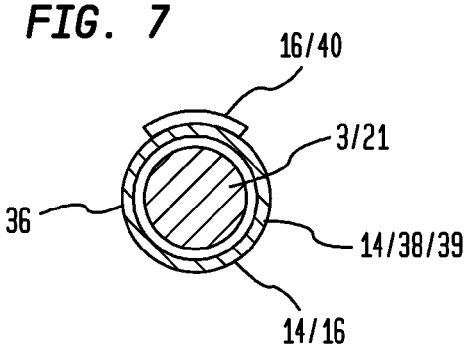
FIG. 7 is a cross sectional view 7-7 of the particular embodiment of the inventive boat hull cleaning device shown in FIG. 2.
Figure 8:
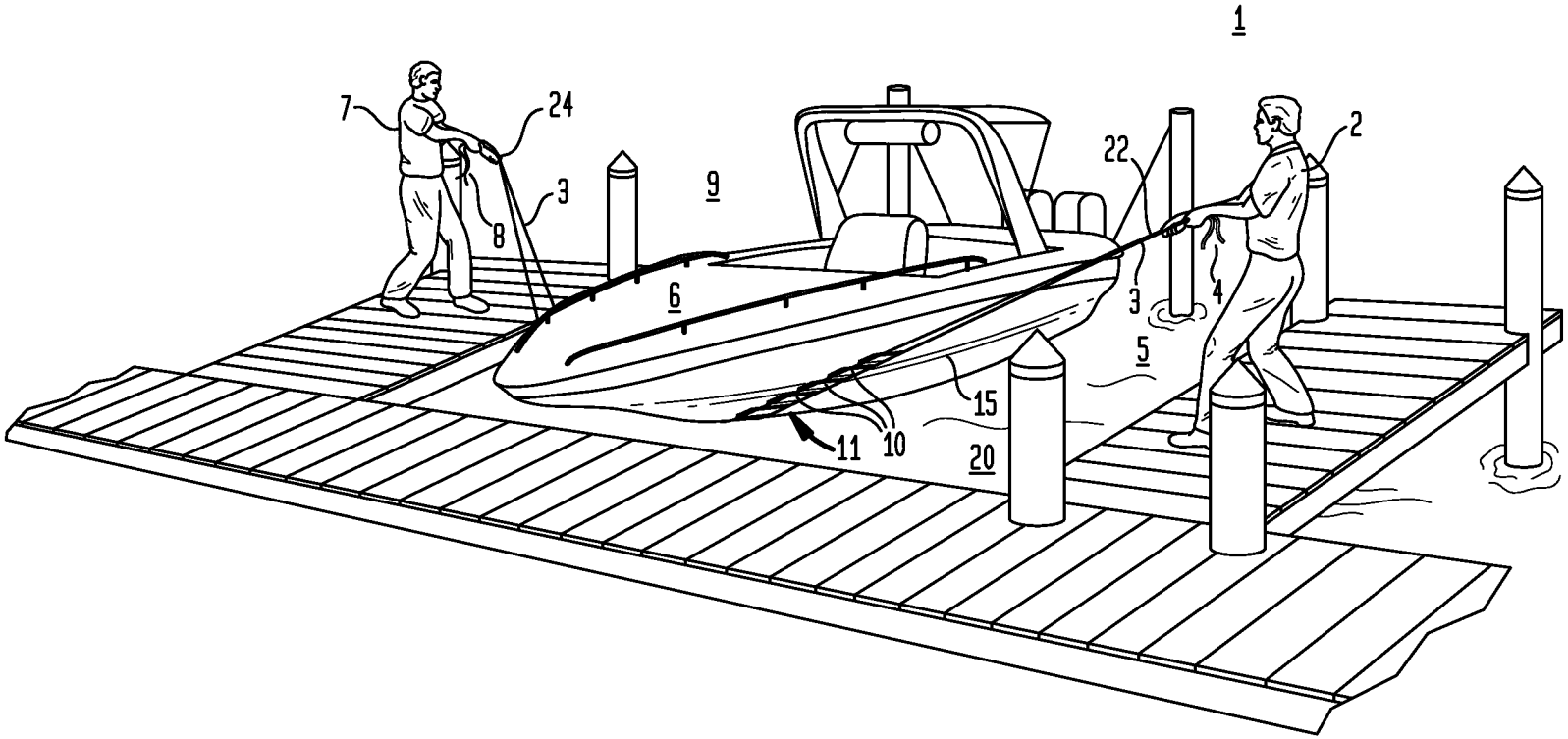
FIG. 8 is an illustration of a particular method of using a particular embodiment of the inventive boat hull cleaning device having a plurality of cleaning elements each having body configured as a flat sheet with a plurality of tufts extending outwardly from at least one face.

First referring primarily to FIGS. 1 and 8, which illustrate a method of using particular embodiments of the inventive boat hull cleaning system (1) shown in the examples of FIGS. 2-7 and as shown in the examples of 9-18. Generally as to embodiments of the inventive boat hull cleaning system, a first person (2) can grip at least one flexible line (3) proximate a first line end (4) on the port side (5) of a boat (6). A second person (7) can grip the flexible line (3) proximate a second line end (8) on the starboard side (9) of the boat (6). A plurality of cleaning elements (10) can be coupled in spaced engagement along a central portion (11) of the flexible line (3). Each of the plurality of cleaning elements (10) can have a plurality of flexible members (12)(or a plurality of tufts (47) each of the plurality of tufts (47) comprising a plurality of flexible members (12)) which extend outwardly from a body (13), at least one flexible line (3) coupled to the body (13), or passing centrally through the body (13), of each of the plurality of cleaning elements (10). The plurality of flexible members (12) or tufts (47) coupled to the body (13) of one or more of the plurality of cleaning elements (10) can be engaged with the boat hull (15) (the boat hull (15) can be submerged to a depth in an amount of water (20) as shown in FIG. 1 or can be supported out of water (20)). The at least one flexible line (3) can be repeatedly reciprocally drawn toward the port side (5) of said boat (6) and then toward the starboard side (9) of the boat (5) to clean the boat hull (15).

Figure 3:
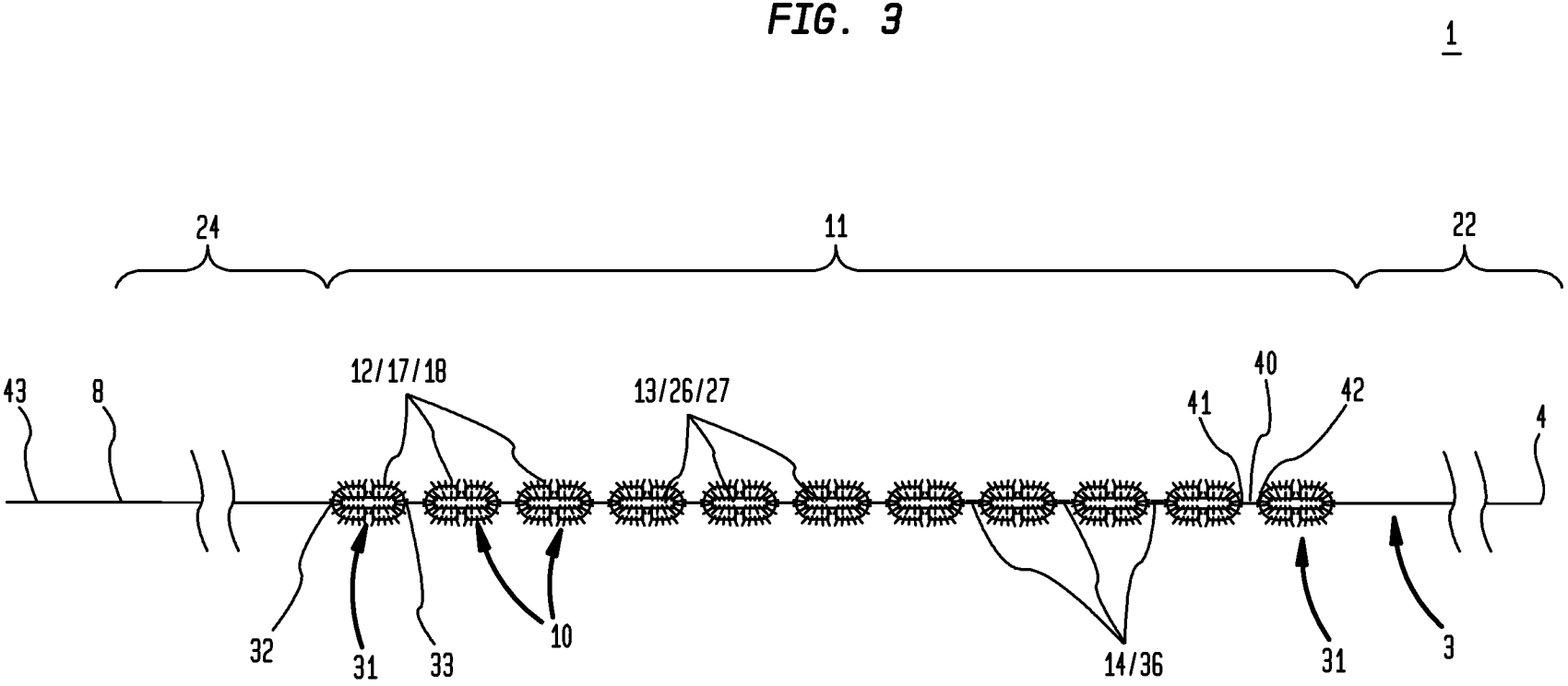
FIG. 3 is a side view of the particular embodiment of the inventive boat hull cleaning device shown in FIG. 2.
Figure 4:
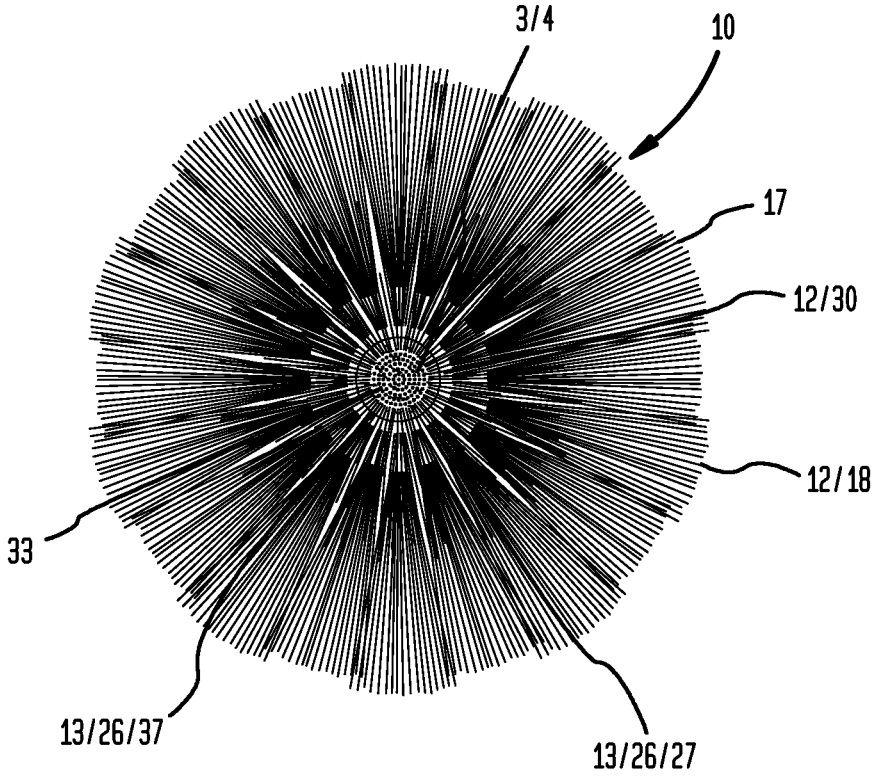
FIG. 4 is an end view of the particular embodiment of the inventive boat hull cleaning device shown in FIG. 2.
Figure 5:
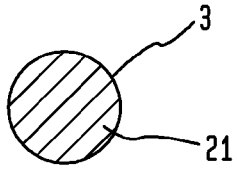
FIG. 5 is a cross sectional view 5-5 of the particular embodiment of the inventive boat hull cleaning device shown in FIG. 2.
Figure 6:
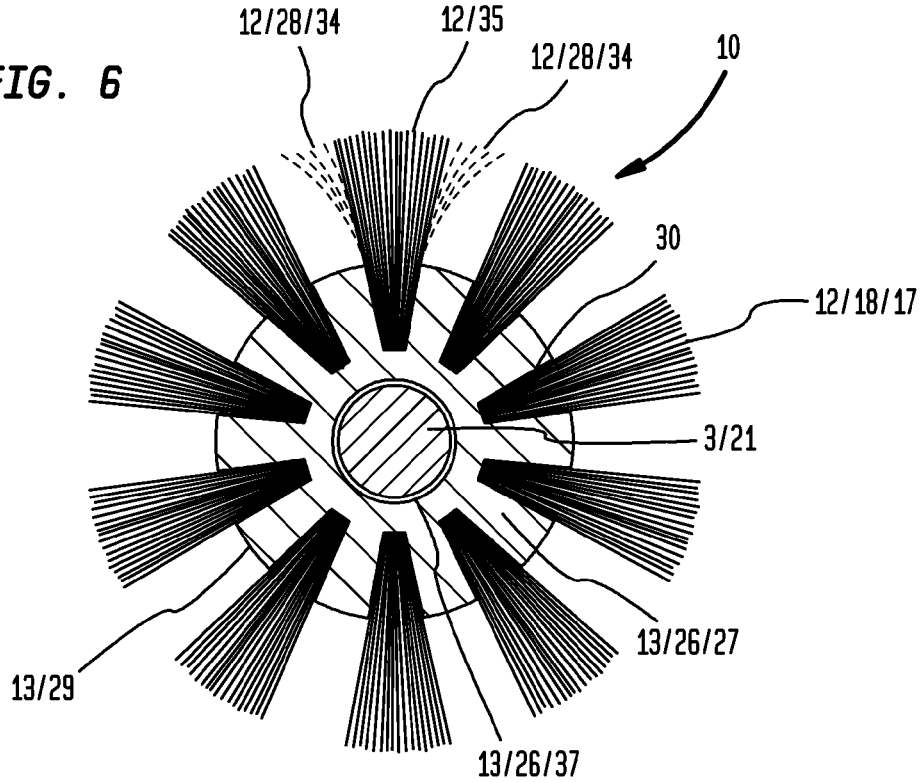
FIG. 6 is a cross sectional view 6-6 of the particular embodiment of the inventive boat hull cleaning device shown in FIG. 2.

Certain embodiments of the method can further include disposing a spacer element (14)(as shown in the example of FIG. 3) between one or more pair of the plurality of cleaning elements (10) to fix location of spaced engagement of each of the plurality of cleaning elements (10) along the central portion (11) of the flexible line (3) depending upon the configuration of the boat hull (15) of the boat (6). Additionally, the method can further include the step adjusting length of one or more spacer element(s) (14) to vary distance of spaced engagement of the plurality of cleaning elements (10) disposed along the central portion (11) of the flexible line (3).

Certain embodiments of the method can further include coupling a stiffener element (16)(as shown in the example of FIG. 7) to the flexible line (3) whether along a continuous length or between one or more pair of the plurality of cleaning elements (10) to increase the rigidity or decrease flexibility of the flexible line (3) between one or more of the plurality of cleaning elements (10) disposed along the central portion (11) of the flexible line (3).

Certain embodiments of the method can further include establishing a flexible member cleaning surface (17) defined by location of the air terminals (18) of the plurality of flexible members (12)(or the plurality of flexible members (12) at a tuft second end (60)) of the plurality of tufts (47)). The flexible member cleaning surface (17) can be generally configured in any manner depending on the configuration of the boat hull (15) such as: a cylinder, a sphere, a prolate spheroid, a cone, a double sided cone, a rectangular volume, a square volume, or combinations thereof.

Now referring primarily to FIGS. 2-7, embodiments of the boat hull cleaning system (1) can include a flexible line (3). Typically, the flexible line (3) will have a generally circular cross sectional area (21) consistent with the twisted, laid, plaited, braided, woven, or winded relation of the fibers or the configuration of the solid material which comprise the flexible line (3); however, the invention is not so limited and other cross sectional configurations of the flexible line (3) can be utilized in accordance with the invention such as oval, square, rectangular, multiple separate strands, or the like. The cross sectional area (21) of the flexible line (3) can be selected to provide the strength, flexibility, elasticity and other characteristics to allow the flexible line (3) to perform the above-described method of cleaning a boat hull (15). Typically, the flexible line (3) having a generally circular cross sectional area (21) will have a diameter in the range of about three eighths inch to about three quarters of an inch. The flexible line (3) can be constructed of natural fibers such as silk, wool, manila hemp, hemp, linen, cotton, coir, jute, sisel, or the like, or more preferably synthetic fibers such as polypropylene, nylon, polyesters, polyethylene, aramids, polyaramids, rayon, or the like, or even metallic fibers such as steel, stainless steel, or the like, or combinations thereof. The flexible line (3) can have a length sufficient to perform the method above described on a numerous and wide variety of boat hull (15) configurations, typically the length can be in the range of about twenty feet and about thirty feet; although depending on the application a lesser or greater length can be utilized. The length of the flexible line (3) can include a central portion (11) located between a first gripable portion (22) proximate a first line end (4) and a second gripable portion (24) proximate a second line end (8).

Figure 12:
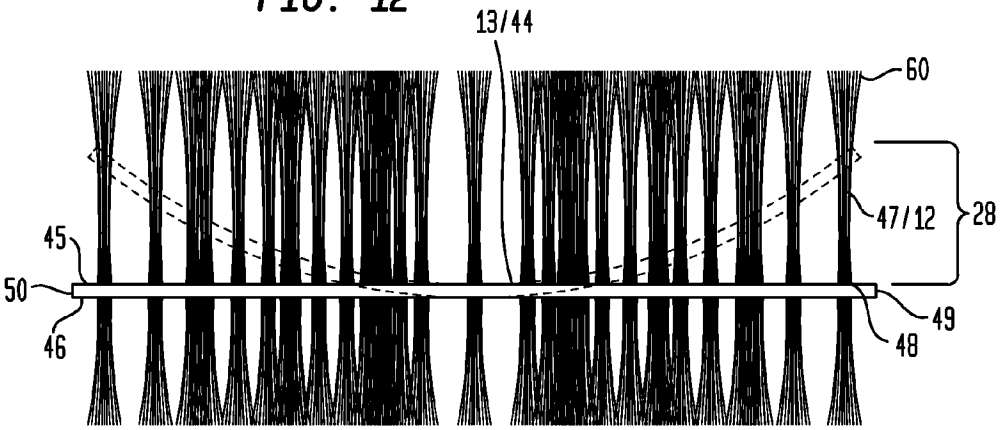
FIG. 12 is a side view of the particular embodiment of a cleaning element which can be utilized in the embodiment shown in FIG. 8 having flexible members of first length extending from a first face and having flexible members of second length extending from a second face.

Again referring primarily to FIGS. 2-7, embodiments of the boat hull cleaning system (1) can further include a plurality of cleaning elements (10) having spaced engagement along the central portion (11) of the flexible line (3). Each of the plurality of cleaning elements (10) can have a body (13) from which a plurality of flexible members (12) extend outwardly. The body (13), under conditions encompassed by the above described method or substantially similar methods, can provide a generally inflexible body (26) molded, formed, or fabricated from a wide variety of materials such as metal, plastic, wood, or the like, to provide configurations to which the plurality of flexible members (12) can be coupled in outward extending relation. As to other embodiments of the invention, the body (13), under conditions encompassed by the above described method or substantially similar methods, can be configured to provide a generally flexible body (27) molded, formed, or fabricated from a wide variety of materials such as metal, plastic, or the like, to provide configurations to which the plurality of flexible members (12) can be coupled in outward extending relation. The flexible body (27) can provide an amount of flexure (28) owing to the elasticity of the material utilized in producing the flexible body (27)(as shown in the example of FIG. 12) or owing to a plurality of segments coupled in movable relation to one another by pivots, hinges, sockets, or the like.

As one non-limiting example, the inflexible body (26) can have a generally cylindrical external surface (29). While the outside diameter of the cylindrical external surface (29) may vary depending on the particular application, typically the cylindrical external surface (29) can have diameter in the range of about three quarters inch and about three inches. Regardless as to whether the body (13) comprises a generally inflexible body (26) or comprises a flexible body (27), the flexible line (3) passes centrally through the body (13)(generally along the longitudinal axis (43) of the body (13) to dispose the external surface (29) of the body (13) of each of the plurality of cleaning elements (10) in substantial symmetry about the flexible line (3), as opposed to coupling the flexible line (3) proximate the external surface (29) of the body (13) or by a portion of the plurality of flexible members (12).

Again referring primarily to FIGS. 2-7, embodiments of the boat hull cleaning system (1) can further include a plurality of flexible members (12) coupled to the body (13) of each of the plurality of cleaning elements (10). Each of the plurality of flexible members (12) can have a length disposed between the coupled end (30) and the air terminal (18). The length of each of the plurality of flexible members (12) can vary based on a number of factors. First, the length of the plurality of members (12) can vary from embodiment to embodiment to define a numerous and wide variety of configurations of a flexible member cleaning surface (17). The flexible member cleaning surface (17) having configuration defined by location of the air terminals (18) of each of the plurality of flexible members (12) can be configured to provide any one or combination of: a cylinder, sphere, prolate spheroid, cone, double sided cone, rectangular volume, square or the like.

As a first example, the plurality of flexible members (12) can be substantially the same length and be coupled to generally extend radially outward from a substantially inflexible cylindrical body (26). Accordingly, the flexible member cleaning surface (17) defined by the location of the corresponding plurality of air terminals (18) can be substantially cylindrical in configuration. As a second example, utilizing substantially the same inflexible cylindrical body (26) as described in the first example, the plurality of flexible members (12) can be coupled to the substantially cylindrical inflexible body (26) to generally extend radially outward with the plurality of flexible members (12) being longest proximate the medial circumference (31) of one or more of the plurality of cleaning elements (10) and incrementally of lesser length approaching each cleaning element end (32)(33), thereby providing a flexible member cleaning surface (17) generally configured as a prolate spheroid (football shaped). Embodiments of this configuration can have a flexible member cleaning surface (17) having a medial diameter of about three inches to about six inches with the diameter being of incrementally lesser approaching each cleaning element end (32)(33). Understandably, a numerous and wide variety of flexible member cleaning surfaces (17) can be encompassed by the invention and even though the Figures show each of the plurality of cleaning elements (10) having substantially the same configuration of flexible member cleaning surface (17) on an individual device, the various configurations can be used separately or in various permutations and combinations on the same or different devices depending on the application.

Additionally, each of the plurality of flexible members (12) can be sufficiently flexibly resilient such that, under the conditions of the method above described or similar method or use, upon being reciprocally drawn toward the port side (5) of the boat (6) or to the starboard side (9) of the boat (6) to clean the boat hull (15) the engaged portion of the plurality of flexible members (12) achieve a flexed condition (34) by curving, folding or bending over all or a portion of the length of the flexible member (12) and upon being disengaged from the boat hull (15) substantially returns to the prior unflexed condition (35). The amount of flexure in the flexed condition (34) can be controlled by varying the length, thickness and the material of the plurality of flexible members (12). The plurality of flexible members (12) can be made from a wide variety of materials including animal hair such as hog bristle or the like; vegetal fiber such as palmyra or the like; synthetic fiber such as nylon, nylon-type 6, nylon-type 6.6, nylon-type 6.12, polyester, polyethylene, polypropylene, polystyrene, acrylic, or the like; metallic strand such as aluminum, carbon steel, nickel silver, stainless steel, or the like, or combinations thereof, depending upon the application. While typically, the plurality of flexible members (12) of any one of the plurality of cleaning elements (10) can be of substantially similar material; the invention is not so limited.

Figure 2:
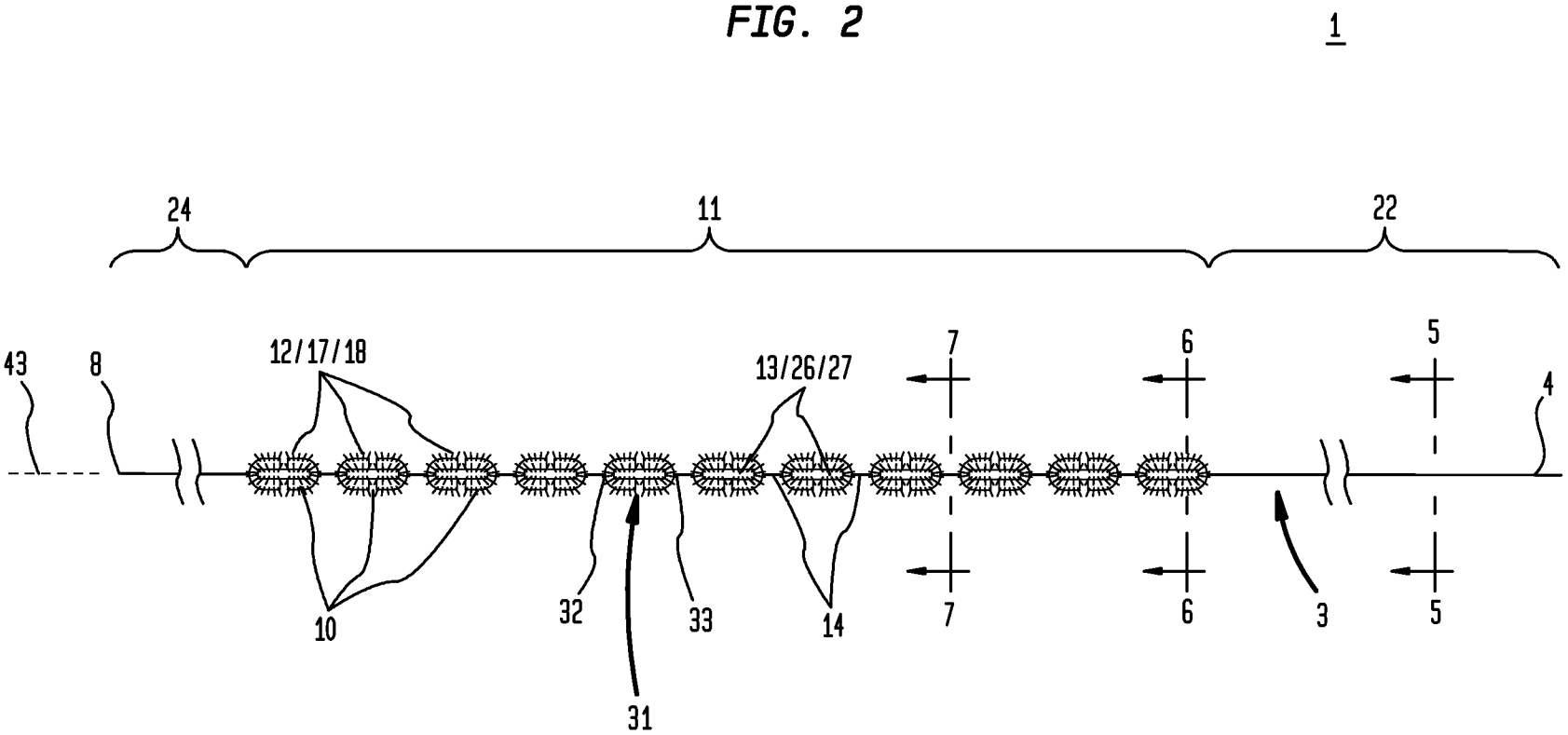
FIG. 2 is a plan view of a particular embodiment of the inventive boat hull cleaning device.

Now referring primarily to FIGS. 2 and 3, the plurality of cleaning elements (10) having spaced engagement along the central portion (11) of the flexible line (3) can be fixedly, slidly, or adjustably slidly coupled to the flexible line (3). As to certain embodiments of the invention, each of the plurality of cleaning elements (10) can have fixed spaced engagement along the central portion (11) of the flexible line (3). The cleaning elements (10) can be spaced in fixed relation to the flexible line (3) by the use of adhesives, compression fit of the body (13) to the corresponding portion of the flexible line (3), molding the body (13) to the corresponding portion of the flexible line (3), enlargement of the flexible line (3) proximate each cleaning element end (32)(33) whether integral to the flexible line (3) or by use of an annular spacer element (36) coupled about the flexible line (3) proximate each cleaning element end (32)(33), or a spacer element (14) coupled about the flexible line (3) between one or more of the pairs of the plurality of cleaner elements (10) or coupled between one or more of the pairs of the plurality of cleaner elements (10). As one non-limiting example, the body (13) of each of the plurality of cleaning elements (10) can provide central longitudinal passage (37) through which the flexible line (3) can pass to allow adjustable spaced engagement of the plurality of cleaning elements (10) along the central portion (11) of the flexible line (3). Adjustable spaced engagement can be achieved by disposing a spacer element (14) between each pair of the plurality of cleaning elements (10) to fix the distance of spaced engagement between the plurality of cleaning elements (10) along said central portion (11) of the flexible line (3). The spacer element (14) can have adjustable length or be adjusted to a particular length to provide fixed adjustable spaced engagement of the plurality of cleaning elements (10) along the central portion (11) of the flexible line (3). As one non-limiting example, the spacer element (14) can be a tubular spacer element (38) defining a tubular circular area (39) in cross section. The tubular spacer element (38) can be configured to provide a selected length disposed between a pair of spacer ends (32)(33). The flexible line (3) can be passed through the tubular spacer element (28) to locate a tubular spacer element (38) between each pair of the plurality of cleaner elements (10) disposed along the central portion (11) of the flexible line (3). Alternately, the spacer element (14) can take the form of an elongate flexible member (40) having each of a pair of member ends (41)(42) coupled to opposed ends (32)(33) of a pair of the plurality of cleaning elements (10)(as shown in the examples of FIGS. 3 and 7).

Again referring primarily to FIGS. 2-7, particular embodiments of the boat hull cleaning system (1) can further include a stiffener element (16) coupled to the flexible line (3) between one or more pair of the plurality of cleaning elements (10)(as shown in the example of FIGS. 3 and 7). The stiffener element (16) reduces or adjusts the amount of flexure of the flexible line (3) between each pair of the plurality of cleaning elements (10) to achieve a particular range of positional relations of the plurality of cleaning elements (10) with the boat hull (15) or between the pairs of the plurality of cleaning elements (10) in performing the above described method or similar methods. As one non-limiting example, as to those embodiments of the boat hull cleaning system (1) which utilize a tubular spacer element (38) between one or more pairs of the plurality of cleaning elements (10), the stiffener element (16) can be integral to the spacer element (14). The amount of stiffness of the stiffener element (16) adjusted by selection of material of the spacer element (14), the thickness of the wall of the spacer element (14), or the like. Similarly, if the spacer element (14) takes the form of an elongate flexible member (40), the stiffener element (16) can be made integral by selection of material of the elongate flexible member (40); however, the stiffener element (16) need not be integral (one piece) with the spacer element (14) and the stiffener element (16) can be of any of a wide variety of materials to which the flexible line (3) can be made responsive or can be coupled to the flexible line (3) between a pair of the plurality of cleaning elements (10) to reduce flexibility of the flexible line (3).

Figure 14:
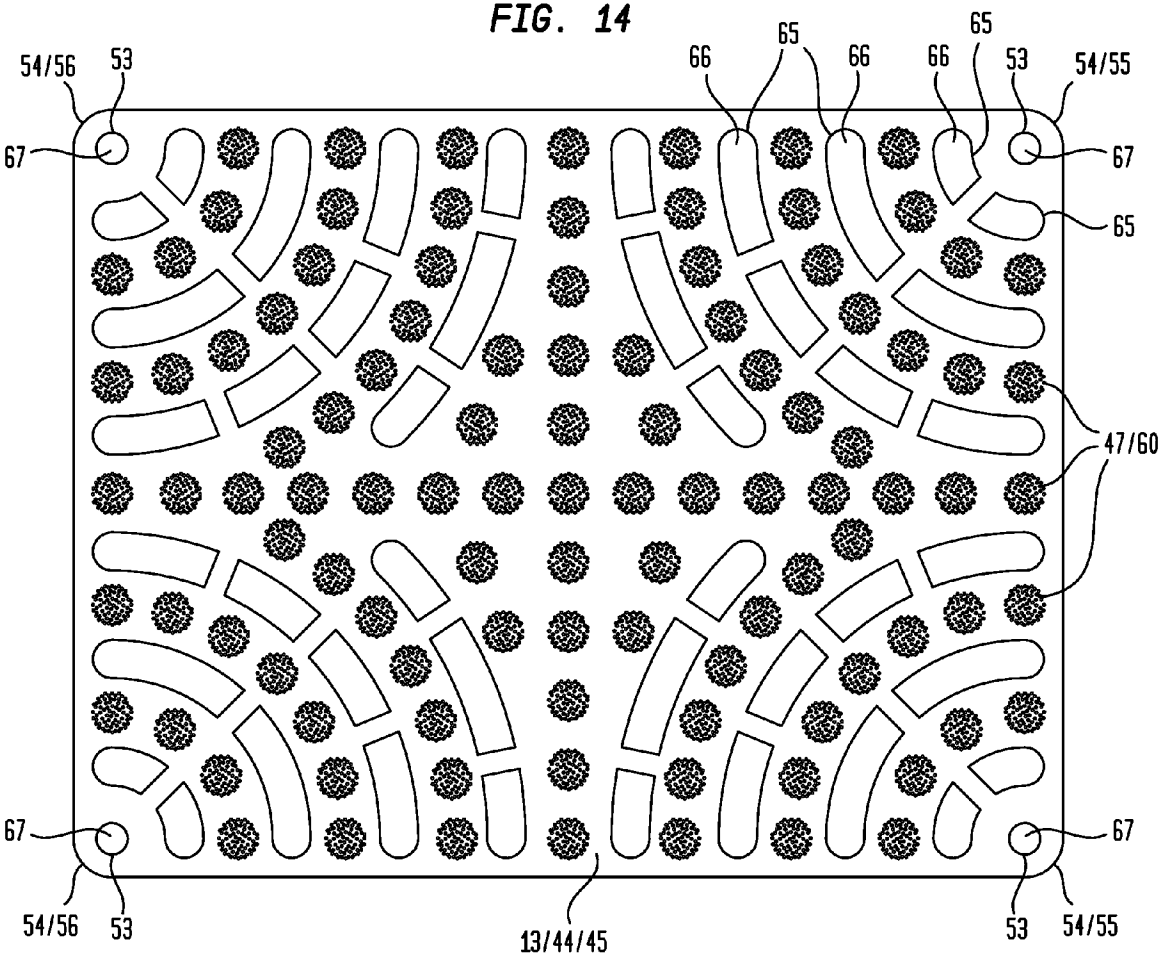
FIG. 14 is a plan view of the particular embodiment of a cleaning element of the embodiment shown in FIG. 8 having flexible members of first length extending from a first face.
Figure 15:
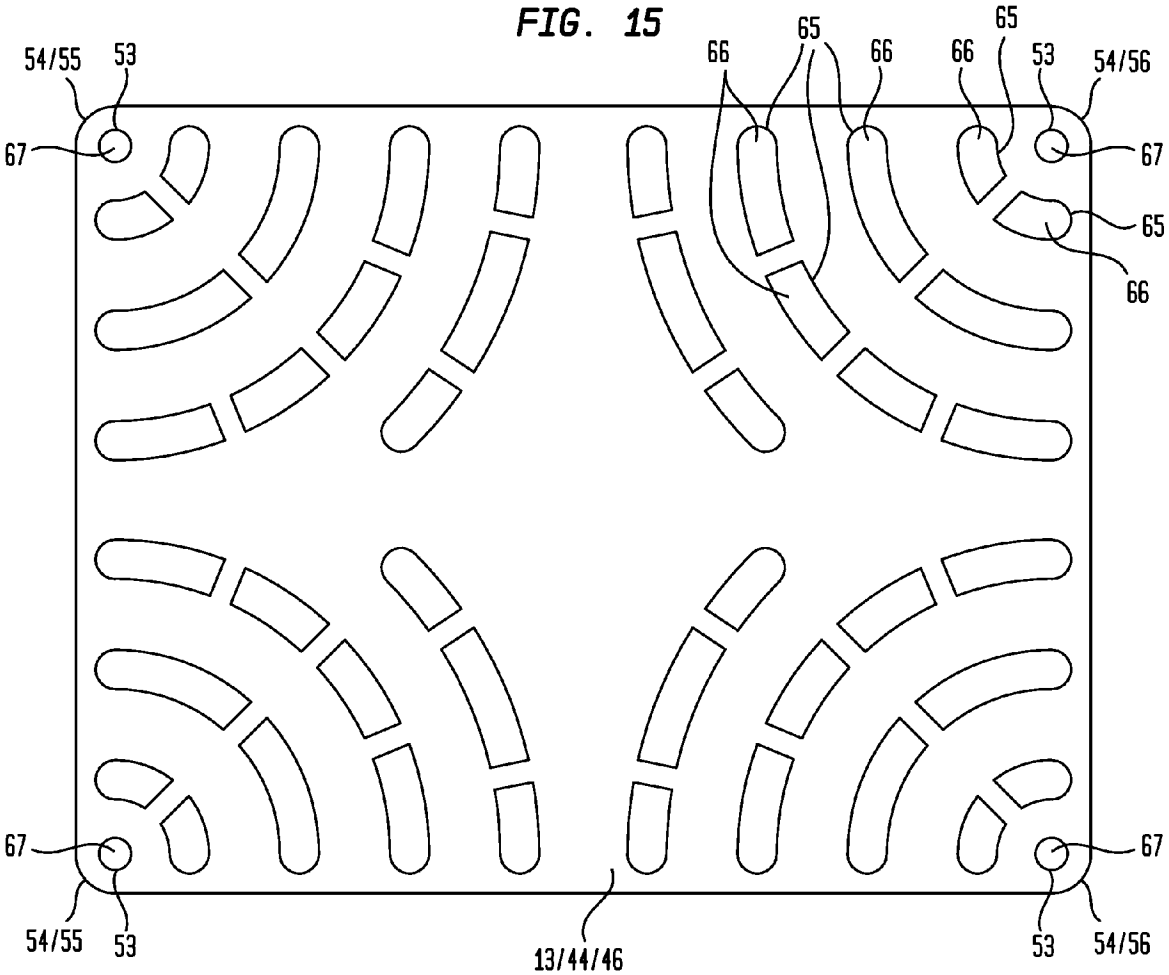
FIG. 15 is a bottom view of the particular embodiment of a cleaning element of the embodiment shown in FIG. 8.
Figure 16:
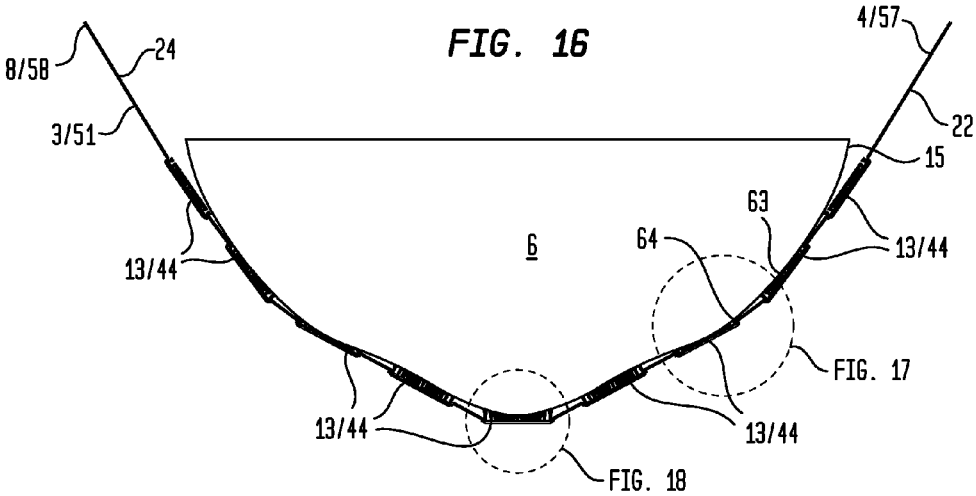
FIG. 16 is an illustration of a particular embodiment of the inventive boat hull cleaning device shown in FIGS. 9-15 used in the method shown in FIG. 8 to clean a boat hull having both raised and recessed portions.
Figure 17:
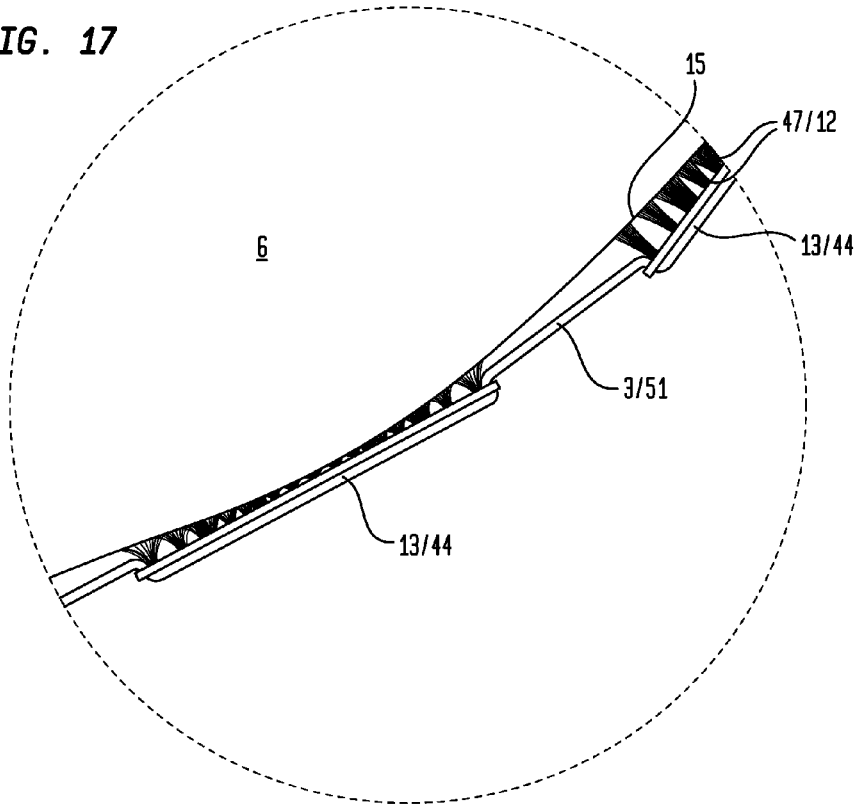
FIG. 17 is an enlarged portion of FIG. 16 showing engagement of one of the plurality cleaning elements in accordance with the embodiment shown in FIG. 8 with both a raised and a recessed portion of a boat hull.

Now referring primarily to FIGS. 9-18, as to particular embodiments of the boat hull cleaning system (1), each of the plurality of cleaning elements (10) can have a body (13) configured as a flat sheet (44) having opposed first and second faces (45)(46), and a plurality of tufts (47) each coupled in spaced relation to the first face (45) by a tuft first end (48). Each of the plurality of tufts (47) can include a plurality of flexible members (12) extending outwardly from the first face (45) to terminate in a tuft second end (60). As to the example shown in FIGS. 10 through 15, the flat sheet (44) can comprise a resiliently flexible rectangular flat sheet (44) having the first face (45) and the second face (46) disposed a distance apart by pairs of opposed sides (49)(50). The resiliently flexible rectangular flat sheet (44) can provide an amount of flexure (28) (as shown in the example of FIG. 12) owing to the elasticity of the material utilized in forming, molding, or otherwise producing the resiliently flexible rectangular flat sheet (44); however, this example is not intended to preclude embodiments in the form of a substantially inflexible flat sheet (as shown in the example of FIGS. 16 and 17) owing the inelasticity of the material used in forming, molding, or otherwise fabricating the flat sheet (44), as above described.

Figure 9:
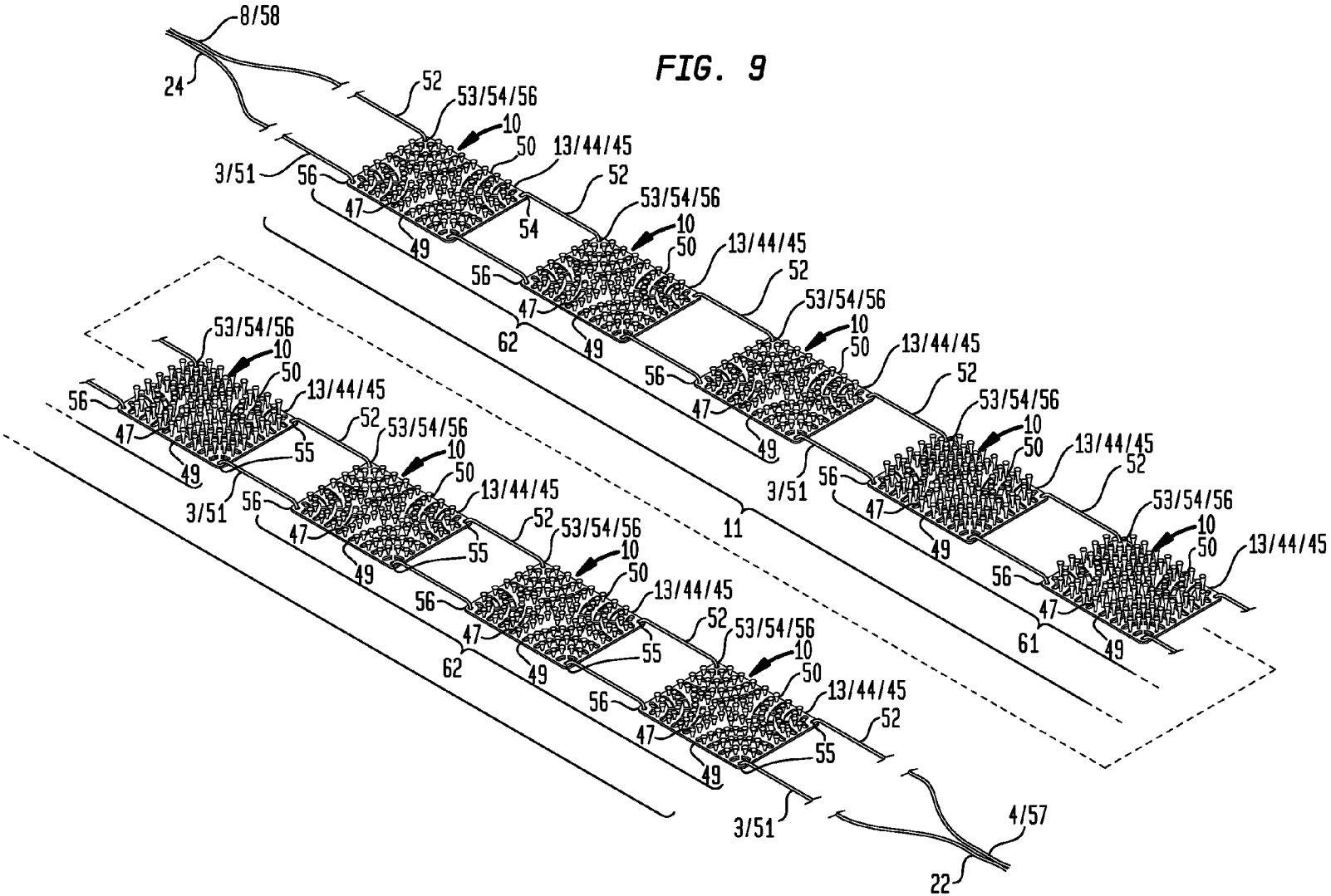
FIG. 9 is an isometric plan view of a particular embodiment of the inventive boat hull cleaning device which can be used in the method shown in FIG. 8.
Figure 10:
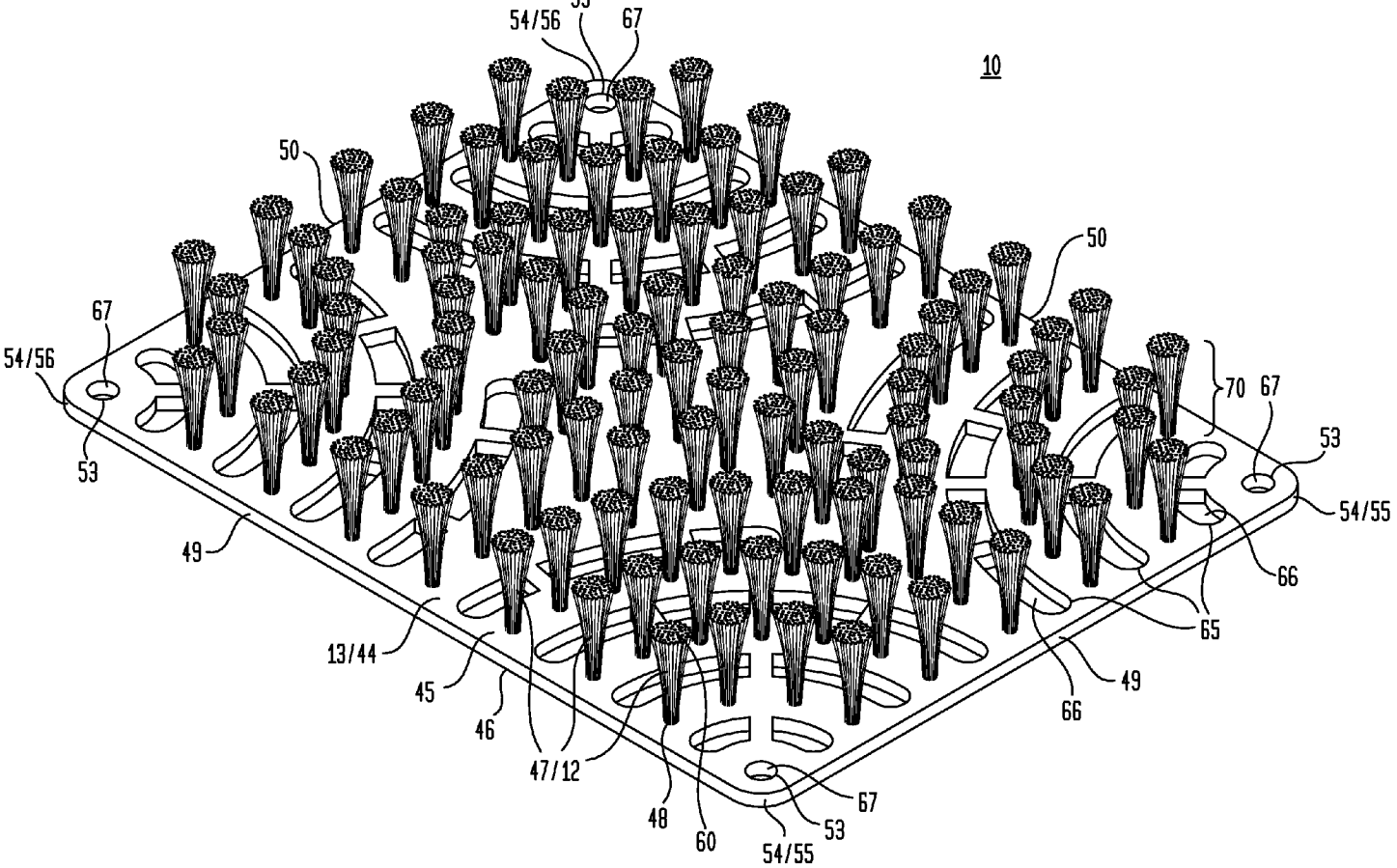
FIG. 10 is an isometric plan view of the particular embodiment of the cleaning element of the particular embodiment shown in FIG. 9 having flexible members of a first length.
Figure 11:
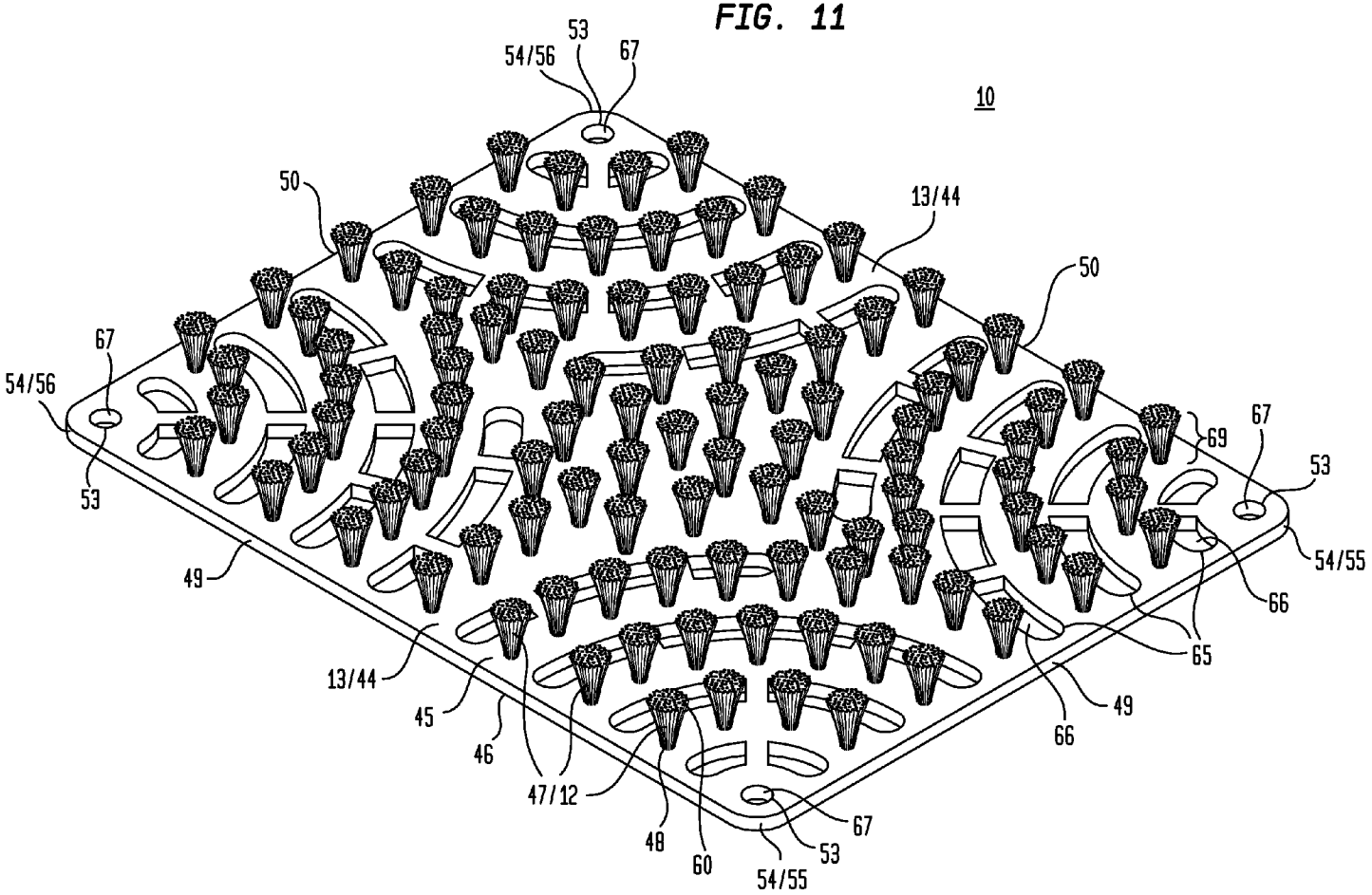
FIG. 11 is an isometric plan view of the particular embodiment of the cleaning element of the particular embodiment shown in FIG. 9 having flexible members of a second length.

As to particular embodiments, a plurality of cleaning elements (10) in the form of a resiliently flexible rectangular flat sheet (44) can have spaced engagement along a central portion (11) of at least one flexible line (3). At least one flexible line (3) can have a length disposed between a first line end (4) and a second line end (8) with a first grippable portion (22) proximate the first line end (4) and a second grippable portion (24) proximate the second line end (8). As shown in the example of FIGS. 9 and 16-17, a plurality of cleaning elements (10) each in the form of a resiliently flexible rectangular flat sheet (44) can have spaced engagement along a central portion (11) of a first flexible line (51) and a second flexible line (52) correspondingly connected proximate a first side (49) and a second side (50) of the resiliently flexible flat sheet (44). As to particular embodiments, a line aperture element (53) can be disposed proximate each corner (54) of the rectangular resilient flexible flat sheet (44) with each line aperture element (53) providing a pass through (67) between the opposed first face (45) and second face (46) of the flat sheet (44)(as shown in the examples of FIGS. 10 and 11) through which a corresponding first and second flexible lines (3)(51)(52) passes to allow slidable spaced engagement of the plurality of cleaning elements (10) along the central portion (11) of the first flexible line (51) and the second flexible line (52). Although particular embodiments can have fixed engagement of the plurality of cleaning elements (10) to the first and second lines (3)(51)(52), as above described. As shown in FIG. 9, the first flexible line (51) can pass through a line aperture element (53) disposed proximate a first corner (55) and a second corner (56) of a first side (49) of each of the plurality of cleaning elements (10). The second flexible line (52) can pass through a line aperture element (53) disposed proximate a first corner (55) and a second corner (56) of a second side (50) of the plurality of cleaning elements (10). As shown in the example of FIG. 9, the first line ends (57) can be drawn against one another to provide a first grippable portion (22) and the second line ends (58) can be drawn against one another to provide a second grippable portion (24).

Figure 13:
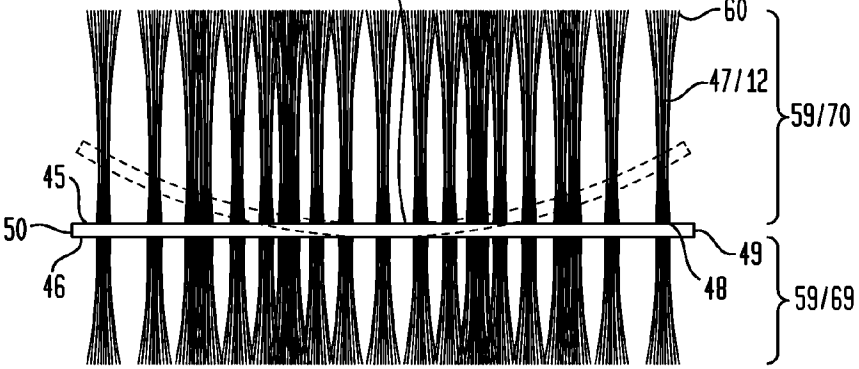
FIG. 13 is an end view of the particular embodiment of a cleaning element of the embodiment shown in FIG. 12 having flexible members of first length extending from a first face and having flexible members of second length extending from a second face.

As to the embodiment of the invention shown in FIGS. 8-18, the tuft length (59) between the tuft first end (48) and the tuft second end (60) can be between about one inch and about three inches (as shown in the example of FIG. 13). As to particular embodiments, the plurality of tufts (47) on each of the plurality of cleaning elements (10) can have substantially the same tuft length (59). As to other embodiments, the plurality of cleaning elements (10) coupled within a middle part (61) of the central portion (11) of the first flexible line (51) and the second flexible line (52) can have a greater tuft length (70)(as shown in the examples of FIGS. 9 and 10) and have a lesser tuft length (69) at opposed end parts (62) of the central portion (11) of the first flexible line (51) and second flexible line (52)(as shown in the example of FIGS. 9 and 11). Alternately, the tuft length (59) can be lesser on those plurality of cleaning elements (10) coupled within a middle part (61) of the central portion (11) of the first flexible line (51) and the second flexible line (52) and have a greater tuft length (59) at opposed end parts (62) of the central portion (11) of the first flexible line (51) and second flexible line (52).

As to certain embodiments, each of the plurality of cleaning elements (10) can further include a plurality of tufts (47) each coupled in spaced engagement to the second face (46) of the flat sheet (44) by a tuft first end (48), each of the plurality of tufts (47) extending outwardly from the second face (46) to terminate in a tuft second end (60) (as shown in the examples of FIGS. 12 and 13). The plurality of tufts (47) coupled in spaced engagement to the first face (45) of the resiliently flexible sheet (44) can have a greater tuft length (70) than the plurality of tufts (47) coupled in spaced engagement to the second face (46) of the resiliently flexible flat sheet (44) having a lesser tuft length (69).

Figure 18:
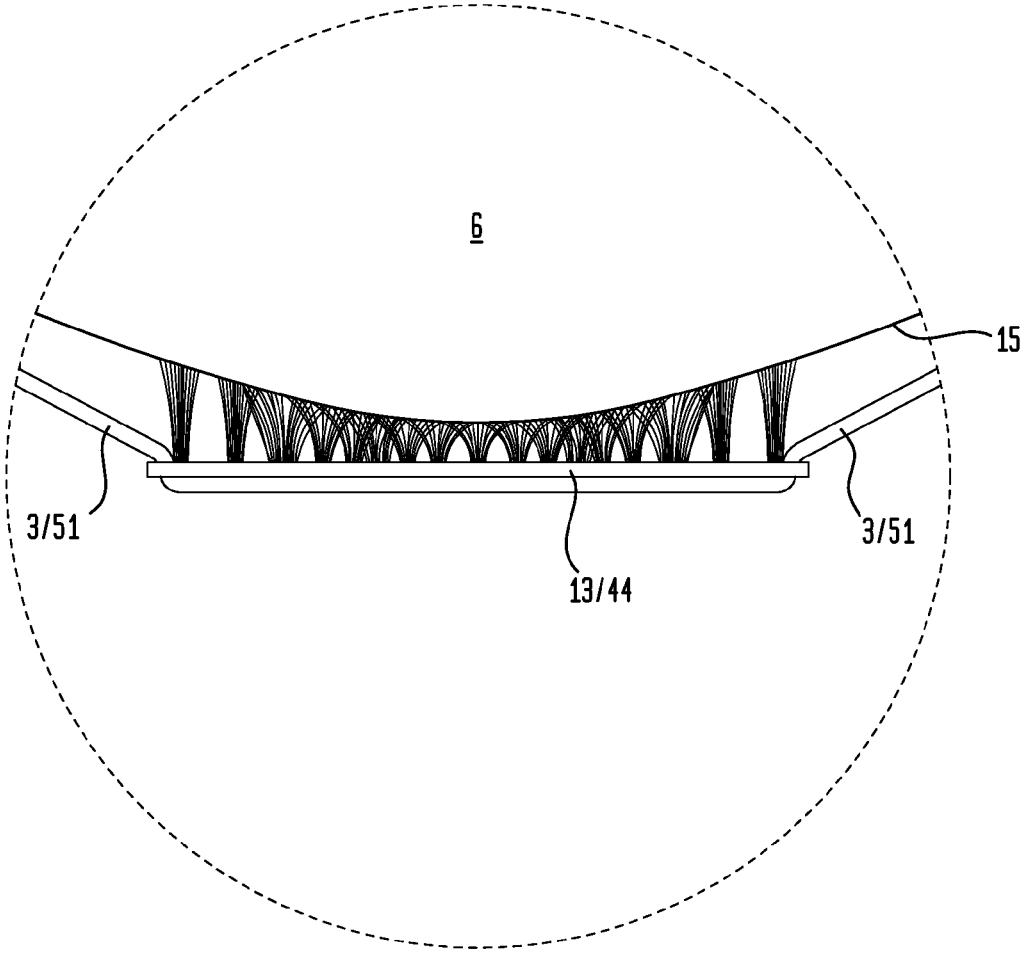
FIG. 18 is an enlarged portion of FIG. 15 showing engagement of one of the plurality of cleaning elements in accordance with the embodiment shown in FIG. 8 with bottom portion of a boat hull.

The plurality of flexible members (12) in each one of the plurality of tufts (47) can be sufficiently flexibly resilient such that, under the conditions of the method above described, or similar method or use, upon being reciprocally drawn toward the port side (5) of the boat (6) or to the starboard side (9) of the boat (6) to clean the boat hull (15) the engaged portion of the plurality of flexible members (12) can achieve a flexed condition (34) by curving, folding or bending over all or a portion of the length of the flexible member (12) and upon being disengaged from the boat hull (15) substantially return to the prior unflexed condition (35) as shown in the example of FIG. 18. The plurality of flexible members (12) can be made from a wide variety of materials, or combinations thereof, as above described.

Now referring primarily to FIGS. 14 and 15, embodiments of the plurality of cleaning elements (10) having the form of a flat sheet (44) can further include a plurality of aperture elements (65) which communicate between opposed first and second faces (45)(46) of the flat sheet (44). The plurality of aperture elements (65) can be disposed in spaced apart relation between said plurality of tufts (47). The plurality of aperture elements (65) can have a sufficient open area (66) to allow material cleaned from the boat hull (15) by action of the plurality of tufts (47) to pass through the plurality of aperture elements (65) to release the material from the plurality of cleaning elements (10) to inhibit abrasion of the boat hull (15) by trapped materials.

A plurality of cleaning elements (10) in the form of flat sheets (44) having a plurality of tufts (47) coupled to a first face (45) or second face (46), or both, can be fixedly, slidly, or adjustably slidly coupled to one flexible line (3) or a first flexible line (51) and a second flexible line (52) as shown in the example of FIG. 2, as above described, and as to particular embodiments an annular spacer element (36)(as shown in the example of FIGS. 3 and 7) can be coupled about a flexible line (3)(51)(52) as above described and can further include a stiffener element (16)(as shown in the example of FIGS. 3 and 7) coupled to the flexible line (3) between one or more pair of the plurality of cleaning elements (10), as above described.

Now referring primarily to FIGS. 16 through 18, which illustrates engagement of the embodiment of the boat hull cleaning system (1) with a boat hull (15) in accordance with the method of using the invention. The embodiment of the invention shown in FIG. 16 illustrates a plurality of cleaning elements (10) at a middle part (61) of the central portion (11) of the first and second flexible lines (51)(52) having a tuft length (59) greater than the tuft length (59) at the opposed end parts (62) of the central portion (11). The tuft length (59) of the cleaning elements (10) coupled to the middle part (61) of the central portion (11) can for example be between two inches and two and one-half inches long allowing the plurality of tufts (59) to engage the surface of the boat hull (15) even when the surface has round bottom as shown in FIGS. 16 and 18 or has substantial recessed portions (64) and raised portions (64) as shown in FIGS. 16 and 17. The advantage in the embodiment of, maintaining engagement of the plurality of tufts (47) over substantially the entirety of body (13) of each of the plurality of cleaning elements (10) with the external surface of the boat hull (15). The configuration of the boat hull (15) approaching the level of the deck can have a flatter external surface and the tuft length (59) can be lesser as shown.

While the apparatus and methods of using the apparatus have been described in the above examples for cleaning a boat hull (15), embodiments of the apparatus and methods of using the apparatus are not necessarily so limited and embodiment of the apparatus and methods of use can include a wide variety of configurations for cleaning a correspondingly wide variety of objects.

Figure 19:
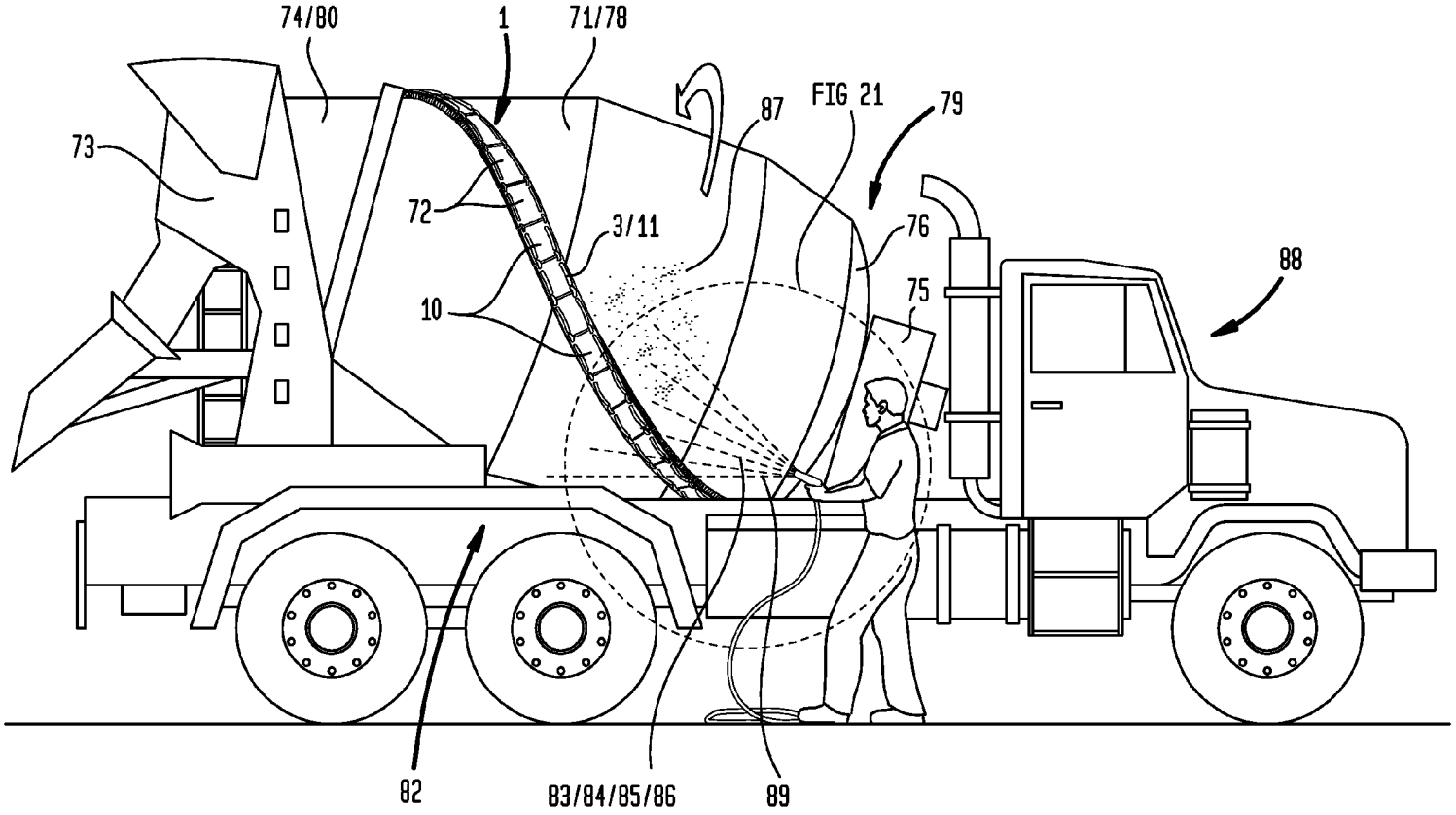
FIG. 19 is first side elevation which illustrates a method of cleaning a rotatable object.
Figure 20:
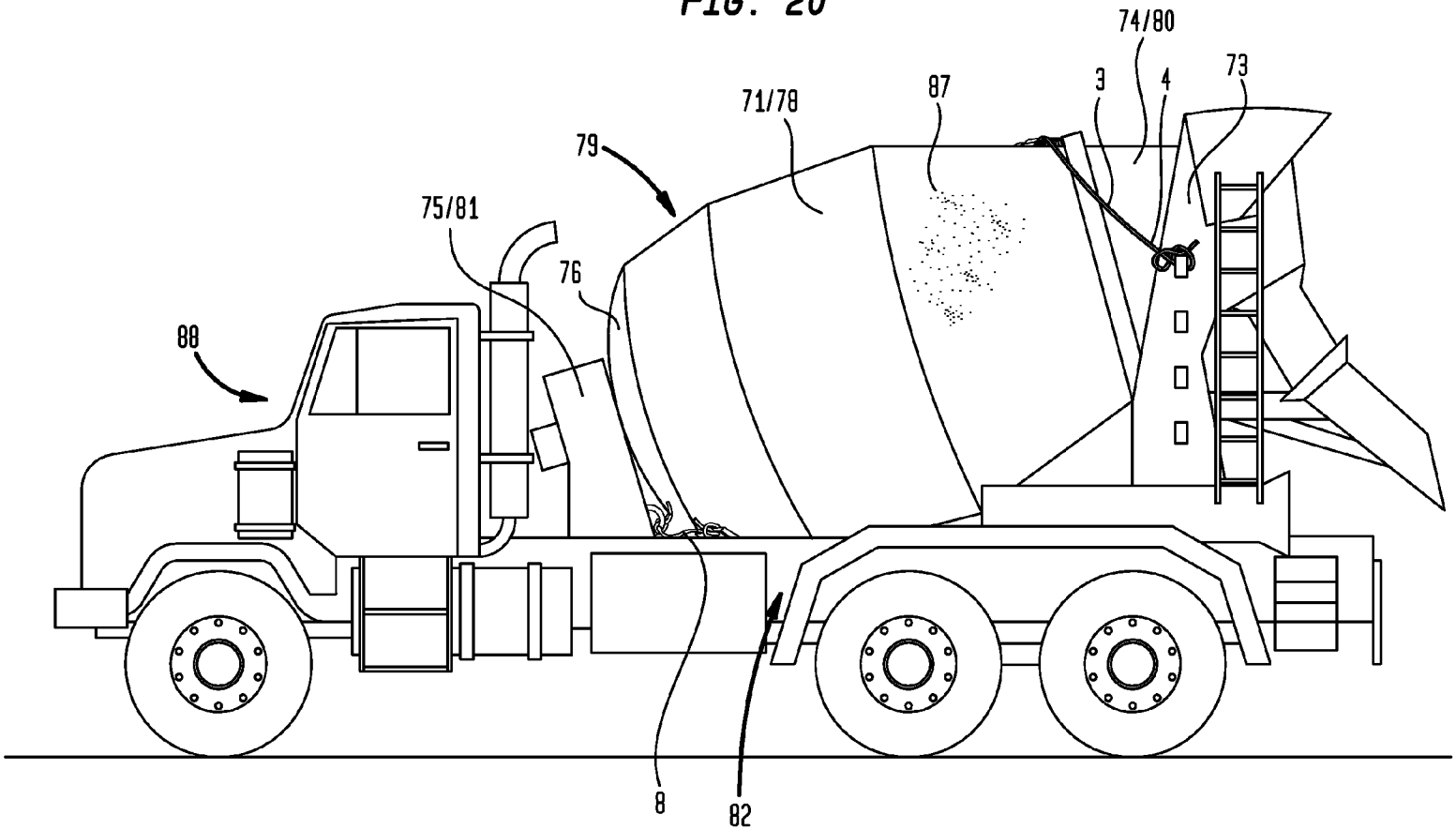
FIG. 20 is a second side elevation which illustrates a method of cleaning a rotatable object.
Figure 21:
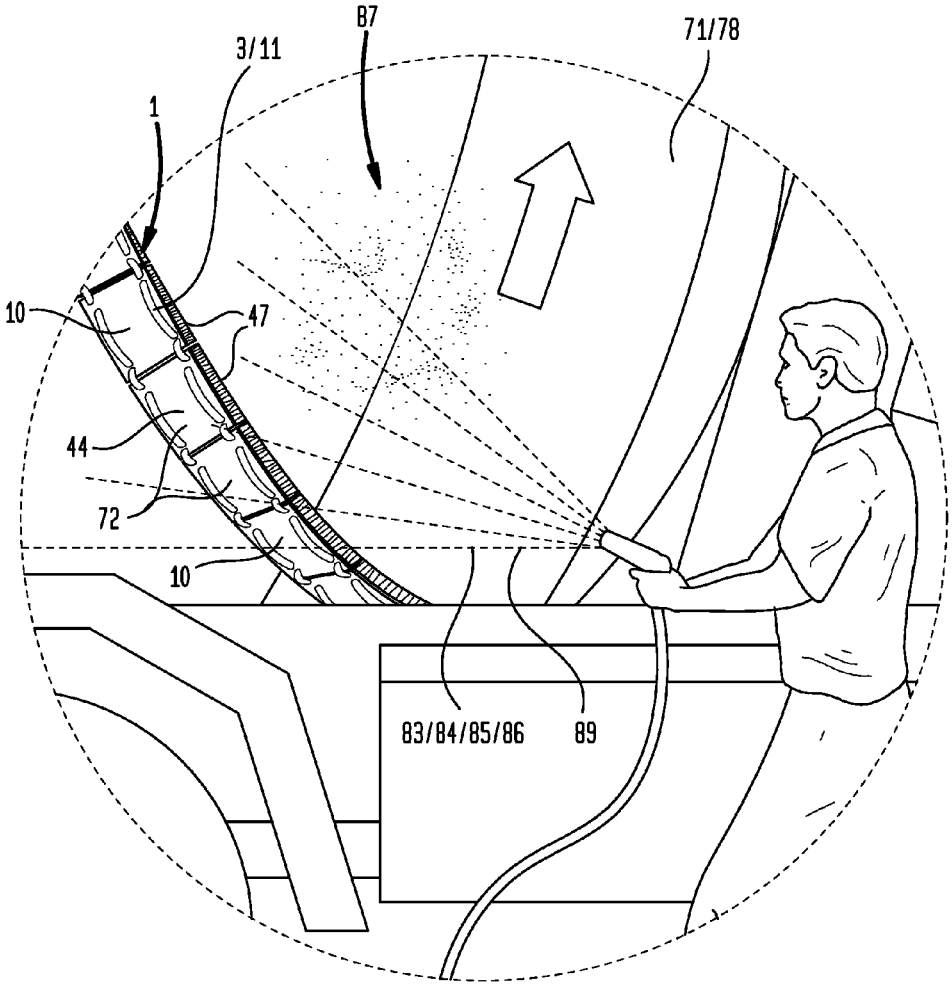
FIG. 21 is an enlargement of a portion of the first side elevation shown in FIG. 19 which illustrates a method of cleaning a rotatable object.

Now referring primarily to FIGS. 19 through 21, which provides an illustrative example of a method of cleaning a rotatable object (71) with an embodiment of the above described cleaning apparatus (1) by obtaining a flexible line (3) including a central portion (11) disposed between first line end (4) and a second line end (8). A plurality of cleaning elements (10) can be disposed along the central portion (11) of the flexible line (3), as above shown and described. As to the particular embodiments shown in FIGS. 19 through 21 each of the plurality of cleaning elements (10) can, but need not necessarily, include a body (13) configured as a flat sheet (44) having a pair of opposed faces (45)(46) and a plurality of tufts (47) each coupled in spaced relation to a first one of said pair of opposed faces (45)(46) by a tuft first end (48)(as shown in the examples of 8 through 18). Each of the plurality of tufts (47), can but need not necessarily, have a plurality of elongate members (12) extending outwardly from the first one of said pair of opposed faces (45)(46) to terminate in a tuft second end (60) (as shown in the example of FIG. 11). Other configurations of the cleaning elements (10), as above described, can be used depending upon the application.

As to particular embodiments of the cleaning apparatus (1) the plurality of cleaning elements (10) can, but need not necessarily be, disposed in spaced engagement along the central portion (11) of the flexible line (3), as above described. The spacing between adjacent pairs (72) of the plurality of cleaning elements (10) or the location of one or more adjacent pairs (72) of the plurality of cleaning elements (10) along the central portion (11) of the flexible line (3) can be fixed by disposing a spacer element (14) (as shown in the examples of FIGS. 3 and 7) between one or more adjacent pairs (72) of the plurality of cleaning elements (10). As to particular embodiments, the spacer element (14) can be configured as an annular spacer element (36), a tubular spacer element (38) or a sufficient enlargement of the line (3), such as by knotting or addition of an amount of adherent material to the line (3). As to particular embodiments, the length of the spacer element (14), or the distance between adjacent pairs (72) of the plurality of cleaning elements (10) along the central portion (11) of the flexible line (3), can be adjusted to be greater or lesser and the distance between adjacent pairs (72) of the plurality of cleaning elements (10) can be equal, substantially equal, or unequal. As to particular embodiments, as shown in the example of FIG. 21, adjacent pairs (72) of the plurality of cleaning elements (10) can be disposed in abutting engagement along the central portion (11) of said flexible line (3). As to particular embodiments, a stiffener element (16) can be coupled to the flexible line (3) between one or more of the adjacent pairs (72) of the plurality of cleaning elements (10).

Again referring primarily to FIGS. 19-21, a method of cleaning a rotatable object (71) include affixing the first line end (4) to a first fixed support (73) proximate a rotatable object first end (74) of a rotatable object (71) and affixing the second line end (8) to a second fixed support (75) proximate a rotatable object second end (76) of the rotatable object (71) with the, rotatable object (71) disposed between said first and second fixed supports (73)(75). The first and second line ends (4)(8) can be affixed to the first and second fixed supports (73)(75) to contact the plurality of tufts (47) coupled to one of the pair of opposed faces (45)(46) of one or more of the plurality of cleaning elements (10) with the rotatable object (71). As to particular embodiments, affixing the first and second line ends (4)(8) can, but need not necessarily include, winding the plurality of cleaning elements (10) disposed along said central portion (11) of the flexible line (3) about the rotatable object (71)(as shown in the example of FIG. 19). The rotatable object (71) can then be rotated between the first and second fixed supports (73)(75) to clean the rotatable object (71) by contact of the plurality of tufts (47) or another cleaning medium (77) supported by body (13), such as sponge, fiber pad, bristles, or the like, or a combination thereof, whether structured as a continuous or spaced apart elements.

Again referring primarily to FIGS. 19-21, the example illustrates a method of cleaning a rotatable object (71) in the form of a drum (78) of a cement mixer (79) rotationally supported between a rear pedestal (80) and a front pedestal (81). As to particular embodiments, the rear pedestal (80) and a front pedestal (81) can be mounted to a truck bed (82) of a truck (88). However, the term rotatable object (73) is not necessarily limited to the drum (78) of a cement mixer (79) and can be any configuration of rotatable object (71) to which the plurality of cleaning elements (10) can conformingly engage and then rotated to clean the external surface.

Now referring primarily to FIGS. 19 and 21, the method can, but need not necessarily include, applying an amount of liquid (83) to the rotatable object (71) or the plurality of cleaning elements (10), or both, whether prior to or during rotation of the rotatable object (71). The amount of liquid (83) can be any liquid (83) which does not degrade, substantially degrade, or is compatible with the rotatable object (71) and the cleaning apparatus (1). As examples, the liquid (83) can include water (84), water (84) combined with an amount of solvent (85)(such as an alcohol, ethanol, methanol, carbon tetrachloride, chromic acid, ammonia, acetic acid, or the like) or a cleaning compositions or agents (86)(such as sodium bicarbonate, trisodium phosphate, sodium percarbonate, chlorine, sodium chloride, surfactants, anionic detergents, cationic detergents, zwitterionic detergents) selected to remove, dislodge, or dissolve adhered materials (87) from the rotating object (73), or combinations thereof. A shown in the example of FIGS. 19 and 21, the liquid (83) can be sprayed (89) onto the rotatable object (71) while stationary or rotating.

As can be easily understood from the foregoing, the basic concepts of the present invention may be embodied in a variety of ways. The invention involves numerous and varied embodiments of a rotatable object cleaning system including devices and methods for cleaning the hull of a boat.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "flexible line" should be understood to encompass disclosure of the act of "flexing a line"—whether explicitly discussed or not—and, conversely, were there effectively disclosure of the act of "flexing a line", such a disclosure should be understood to encompass disclosure of a "flexible line" and even a "means for flexing a line." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the boat hull cleaning systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A method of cleaning a rotatable object, comprising:

obtaining a cleaning apparatus including:

a flexible line including a central portion disposed between first line end and a second line end; and a plurality of cleaning elements disposed along said central portion of said flexible line, each of said cleaning elements having body configured as a flat sheet having a pair of opposed faces and a plurality of tufts each coupled in spaced relation to a first one of said pair of opposed faces by a tuft first end, each of said plurality of tufts comprising a plurality of elongate fibers extending outwardly from said first one of said pair of opposed faces to terminate in a tuft second end;

affixing said first line end to a first support having a fixed location proximate a first end said rotatable object;

affixing said second line end to a second support having a fixed location proximate a second end of said rotatable object, said rotatable object disposed between said first and second supports, said plurality of tufts coupled to said first one of said pair of opposed faces of said plurality of cleaning elements contacting said rotatable object; and rotating said rotatable object to clean said rotatable object.

2. The method of claim 1, further comprising applying an amount of liquid to said rotatable object or said plurality of cleaning elements.

3. The method of claim 2, wherein said amount of liquid comprises water or an amount of cleaning composition.

4. The method of claim 1, wherein affixing said first and second line ends further comprises winding said plurality of cleaning elements disposed along said central portion of said flexible line about said rotatable object.

5. The method of claim 1, further comprising disposing said plurality of cleaning elements in spaced engagement along said central portion of said flexible line.

6. The method of claim 5, further comprising disposing a spacer element between an adjacent pair of said plurality of cleaning elements to fix location of spaced engagement of said adjacent pair of said plurality of cleaning elements along said central portion of said flexible line.

7. The method of claim 6, further comprising adjusting length of said spacer element to adjust spaced engagement of said adjacent pair of said plurality of cleaning elements along said central portion of said flexible line.

8. The method of claim 7, further comprising coupling a stiffener element to said flexible line between said pair of said plurality of cleaning elements.

9. The method of claim 1, further comprising disposing said plurality of cleaning elements in abutting engagement along said central portion of said flexible line.

10. The method of claim 1, wherein said rotatable object comprises a drum of a cement mixer rotationally supported between a rear pedestal and a front pedestal.

11. The method of claim 1, wherein said rear pedestal and said front pedestal are mounted to a truck.

* * * * *